US008523691B2

(12) United States Patent
Chen

(10) Patent No.: US 8,523,691 B2
(45) Date of Patent: Sep. 3, 2013

(54) COMBINATION STRUCTURE FOR A LABYRINTH

(76) Inventor: Chia-Chern Chen, Tainan (TW)

( * ) Notice: Subject to any disclaimer, the term of this patent is extended or adjusted under 35 U.S.C. 154(b) by 251 days.

(21) Appl. No.: 13/227,489

(22) Filed: Sep. 8, 2011

(65) Prior Publication Data

US 2013/0065700 A1 Mar. 14, 2013

(51) Int. Cl.
*A63J 11/00* (2006.01)

(52) U.S. Cl.
USPC ..... 472/62

(58) Field of Classification Search
USPC ..... 472/62
See application file for complete search history.

(56) References Cited

U.S. PATENT DOCUMENTS 7,137,898 B2 * 11/2006 Savage ..... 472/62
7,654,910 B2 * 2/2010 Chen ..... 472/62
7,749,087 B2 * 7/2010 Elias ..... 472/62

* cited by examiner

*Primary Examiner* — Michael Dennis

(57) ABSTRACT

A combination structure for a labyrinth includes plural labyrinth units, which are combined into various labyrinths, respectively composed of four frame rods, a reinforcing support bar and plural fixing members. The four frame rods have their ends butt jointed to form into a square, each frame rod is formed with two connecting ends respectively cut with a recess and provided with an insert hole and each having its wall bored with plural insert holes. The reinforcing support bar is obliquely set inside the four frame rods and formed with two connecting ends respectively bored with an insert hole and having two sides respectively cut with a lengthwise recess. The fixing members are inserted in the insert holes of the connecting ends of the four frame rods and of the reinforcing support bar for securing the four frame rods and the reinforcing support bar together to form a labyrinth unit.

3 Claims, 8 Drawing Sheets

COMBINATION STRUCTURE FOR A LABYRINTH

BACKGROUND OF THE INVENTION

1. Field of the Invention

This invention relates to a combination structure for a labyrinth, particularly to one that is convenient to be assembled, disassembled and transported and can be changed and recombined to form different routes as one pleases, diversified in labyrinth play, safe in use and able to attain an effect of implying instruction in amusement.

2. Description of the Prior Art

Generally, a conventional labyrinth structure sets up outdoors for amusement or for teaching includes several separating plates and firm joint members combined together. The firm joint members of the conventional labyrinth structure are generally screws or iron nails, and the routes designed for the conventional labyrinth are fixed, impossible to be changed at will, and after played for several times, the fixed routes of the conventional labyrinth have been already memorized by the players and become familiar to them, thus losing pleasure and challenge of play in the labyrinth and failing to arouse public interest and in consequence, leaving the labyrinth structure deserted. Therefore, the labyrinth routes have to be changed frequently for continuously maintaining novelty of the labyrinth play; nevertheless, detaching the components of the labyrinth and then reassembling them together to set up a new labyrinth will take much time and require lots of troubles and in the course of detachment, the separating plates are apt to be damaged and impossible to be reused, not only wasting materials but also contaminating the environment as well. Further, the fixed type labyrinth components are extremely huge in volume, which are not easy to be moved about and will take too much space in transportation. Furthermore, after being assembled to make a labyrinth, the separating plates are in a closed condition and hence, the moving directions of the players in the labyrinth cannot be seen from the outside. Thus, when children are playing in the labyrinth, parents are unable to know where the children are, and the children inside the labyrinth may begin to cry because of panic and even worse, danger may occur to the children.

SUMMARY OF THE INVENTION

This invention is devised to offer a combination structure for a labyrinth, convenient in assembly and disassembly, applicable to any site, easy to be detached and recombined at will to make up a new labyrinth with different routes, diversified in labyrinth play and safety in use.

The combination structure for a labyrinth in the present invention includes lots of labyrinth units combined together to make up various labyrinths with different routes. Each labyrinth unit is composed of four frame rods, a reinforcing support bar and a plurality of fixing members. The four frame rods have their ends mutually and vertically butt jointed to form into a square, and each frame rod has two ends respectively formed with a connecting end that is lengthwise cut with a recess and bored with an insert hole and has its wall bored with plural insert holes. The reinforcing support bar is obliquely set inside the four frame rods and has two ends formed with connecting ends respectively bored with an insert hole and having two sides respectively and axially cut with a recess. The fixing members are inserted through the insert holes of the connecting ends of the four frame rods and in the insert holes of the connecting ends of the reinforcing support bar for firmly fastening the four frame rods and the reinforcing support bar together to make up a labyrinth unit.

Each frame rod of this invention has one connecting end axially cut with a one-half recess and another connecting end axially cut with a two-thirds recess, while the reinforcing support bar has two sides of each connecting end respectively and axially cut with a one-third recess.

The fixing members of this invention are tightening cords respectively having one end provided with female threads and another end provided with male threads.

Two labyrinth units of this invention can be firmly butt jointed together by means of the fixing members that are inserted in the mutually-aligned insert holes in the walls of the two frame rods of the labyrinth units.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
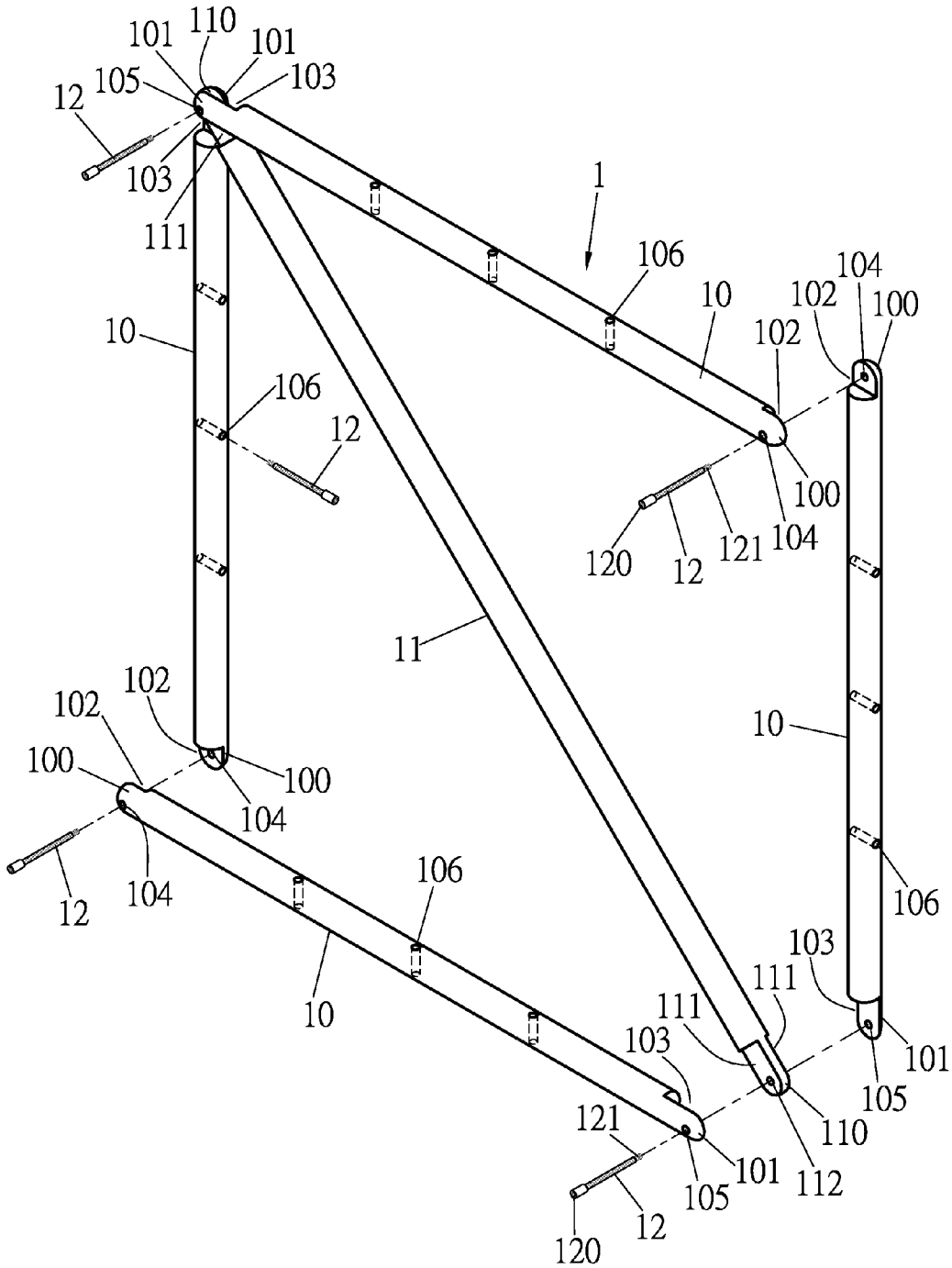
FIG. 1 is an exploded perspective view of a combination structure for a labyrinth in the present invention.
Figure 2:
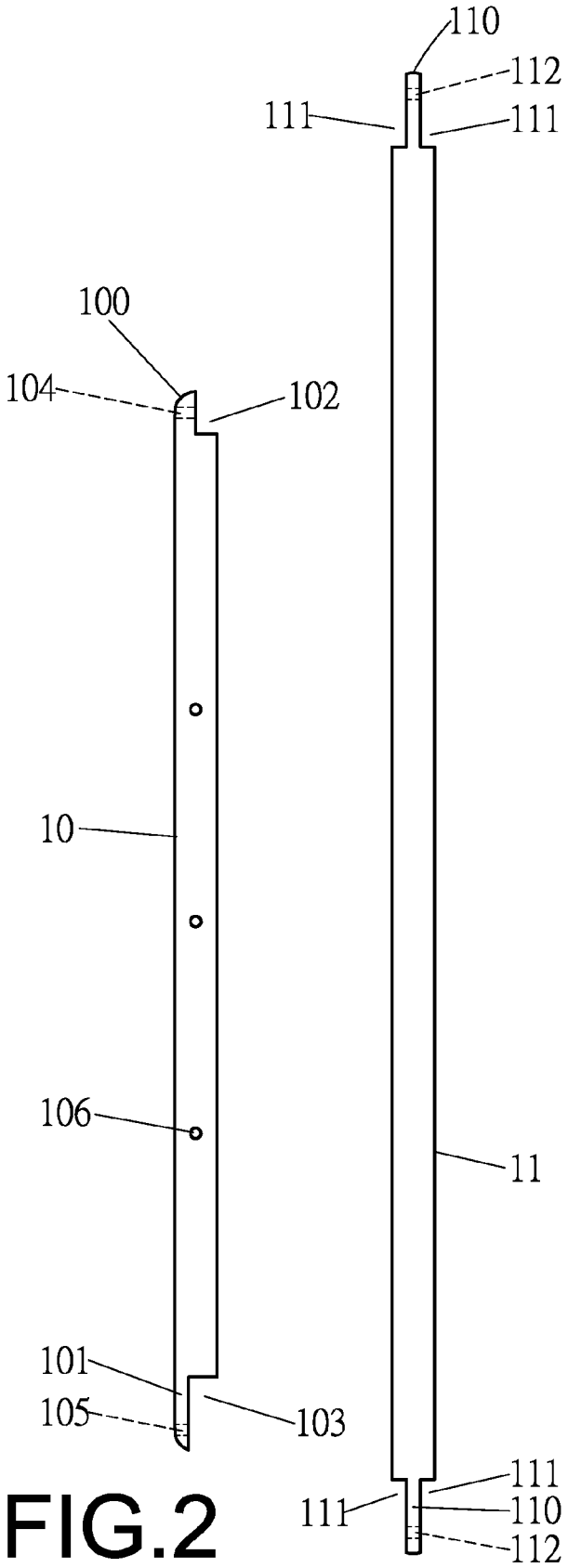
FIG. 2 is a schematic view of a frame rod and a reinforcing support bar in the present invention.
Figure 3:
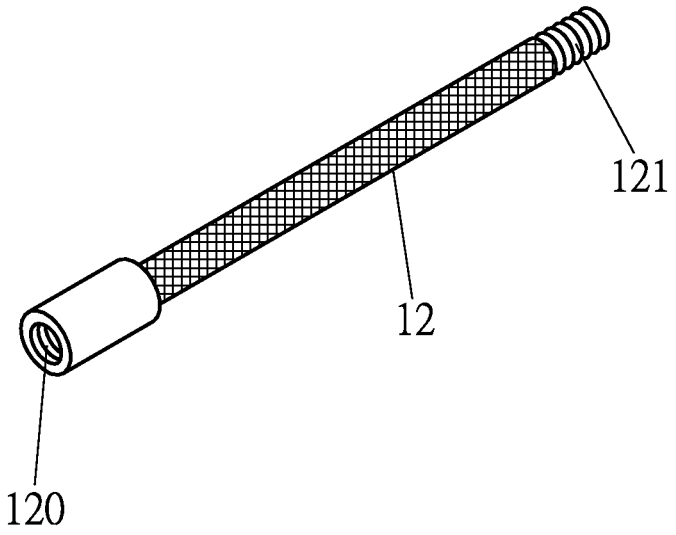
FIG. 3 is a magnified perspective view of a fixing member in the present invention.

A preferred embodiment of a combination structure for a labyrinth in the present invention, as shown in FIGS. 1-3, includes several labyrinth units 1 combined together, and each labyrinth unit 1 is composed of four frame rods 10, a reinforcing support bar 11 and a plurality of fixing members 12.

The four frame rods 10 are vertically butt jointed and formed into a square, and each frame rod 10 has two ends respectively provided with a connecting end 100, 101. The connecting end 100 is axially cut with a one-half recess 102 and bored with an insert hole 104, while another connecting end 101 is axially cut with a two-thirds recess 103 and disposed with an insert hole 105, and each frame rod 10 has its wall provided with a plurality of insert holes 106.

The reinforcing support bar 11 is to be obliquely set inside the four frame rods 10 and has two ends respectively formed into a connecting end 110, which is bored with an insert hole 112 and has two sides respectively and lengthwise cut with a one-third recess 111.

Figure 4:
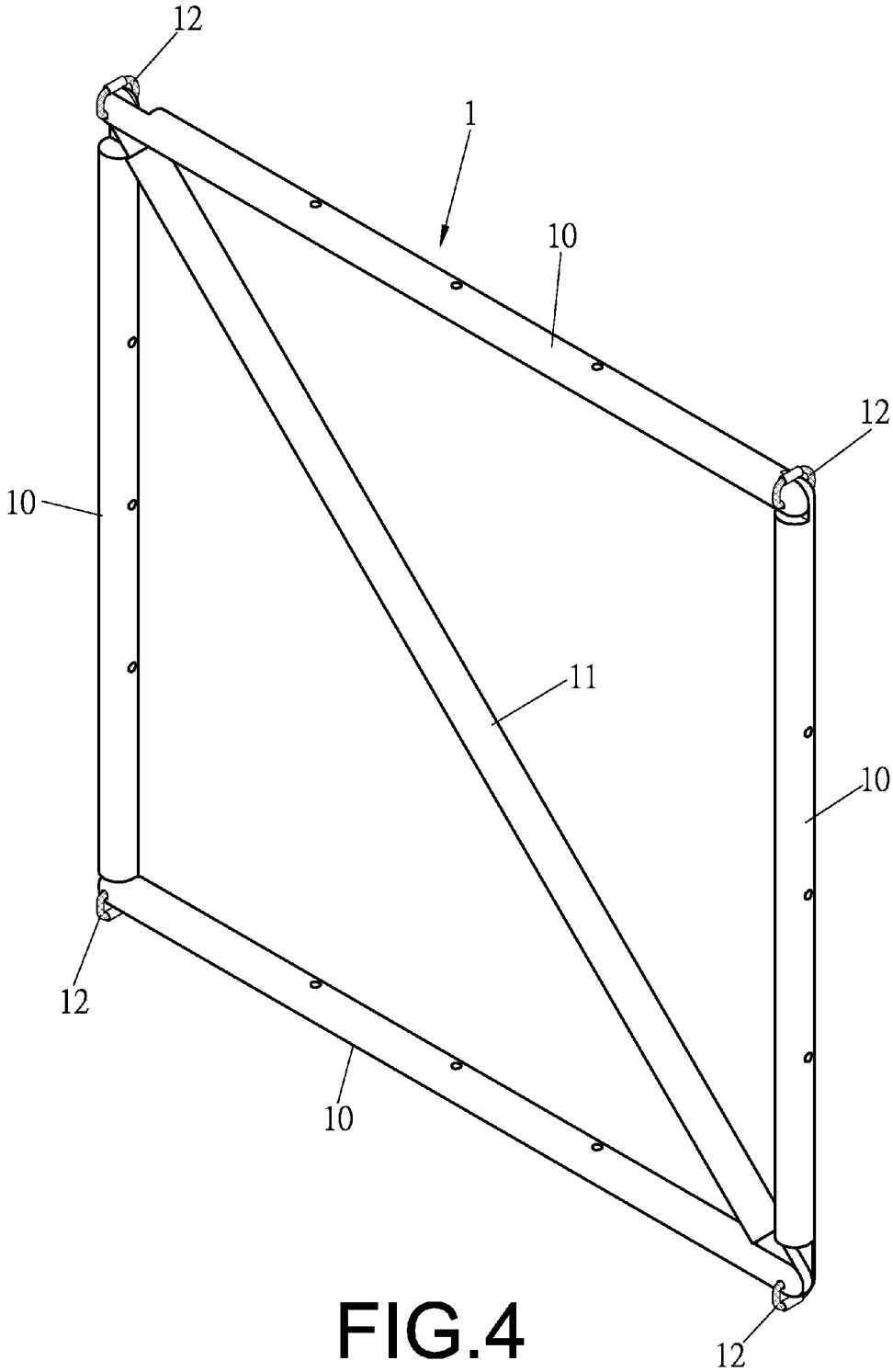
FIG. 4 is a perspective view of a labyrinth unit in the present invention.
Figure 5:
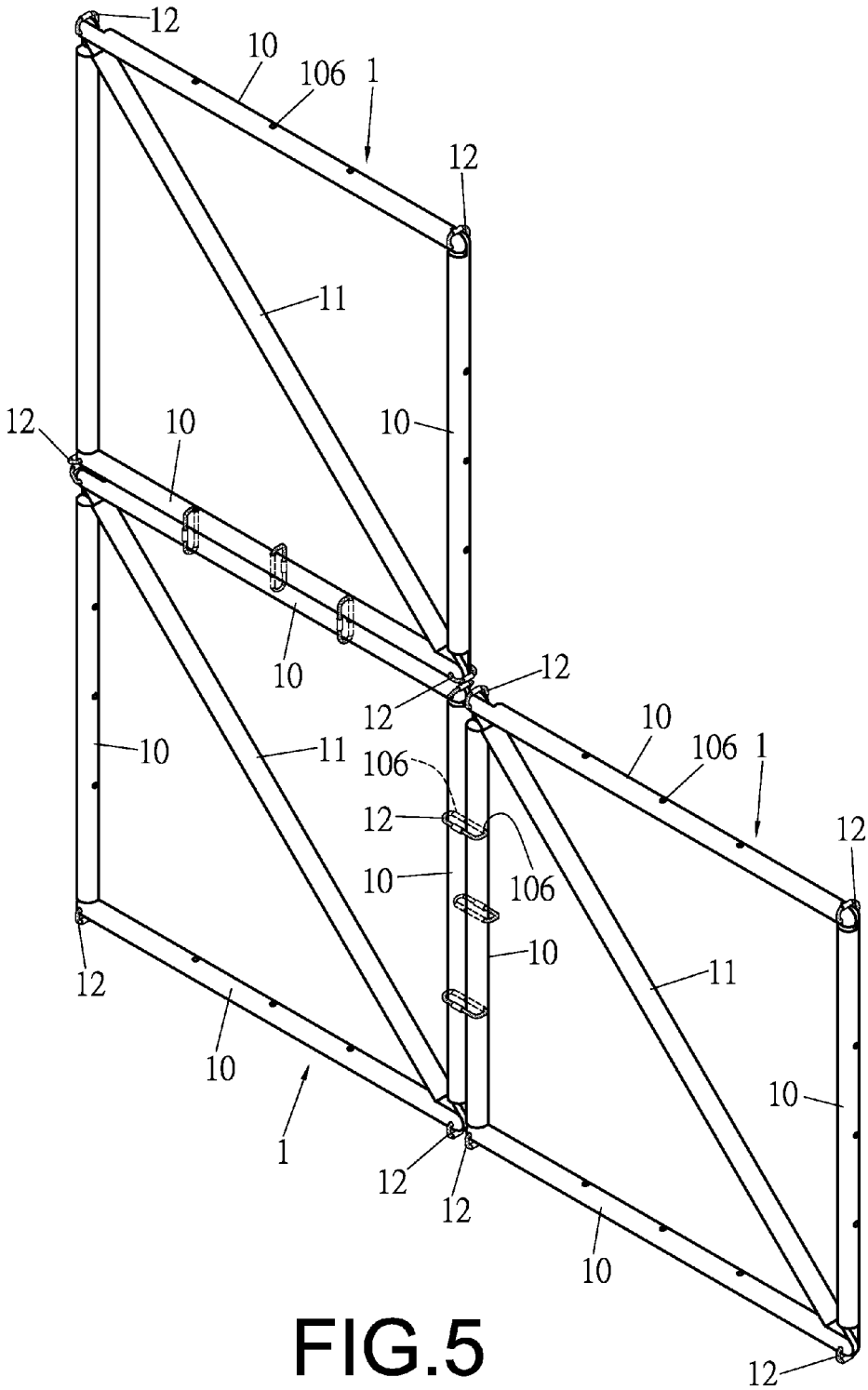
FIG. 5 is a perspective view of having two labyrinth units butt jointed with each other in the present invention.
Figure 6:
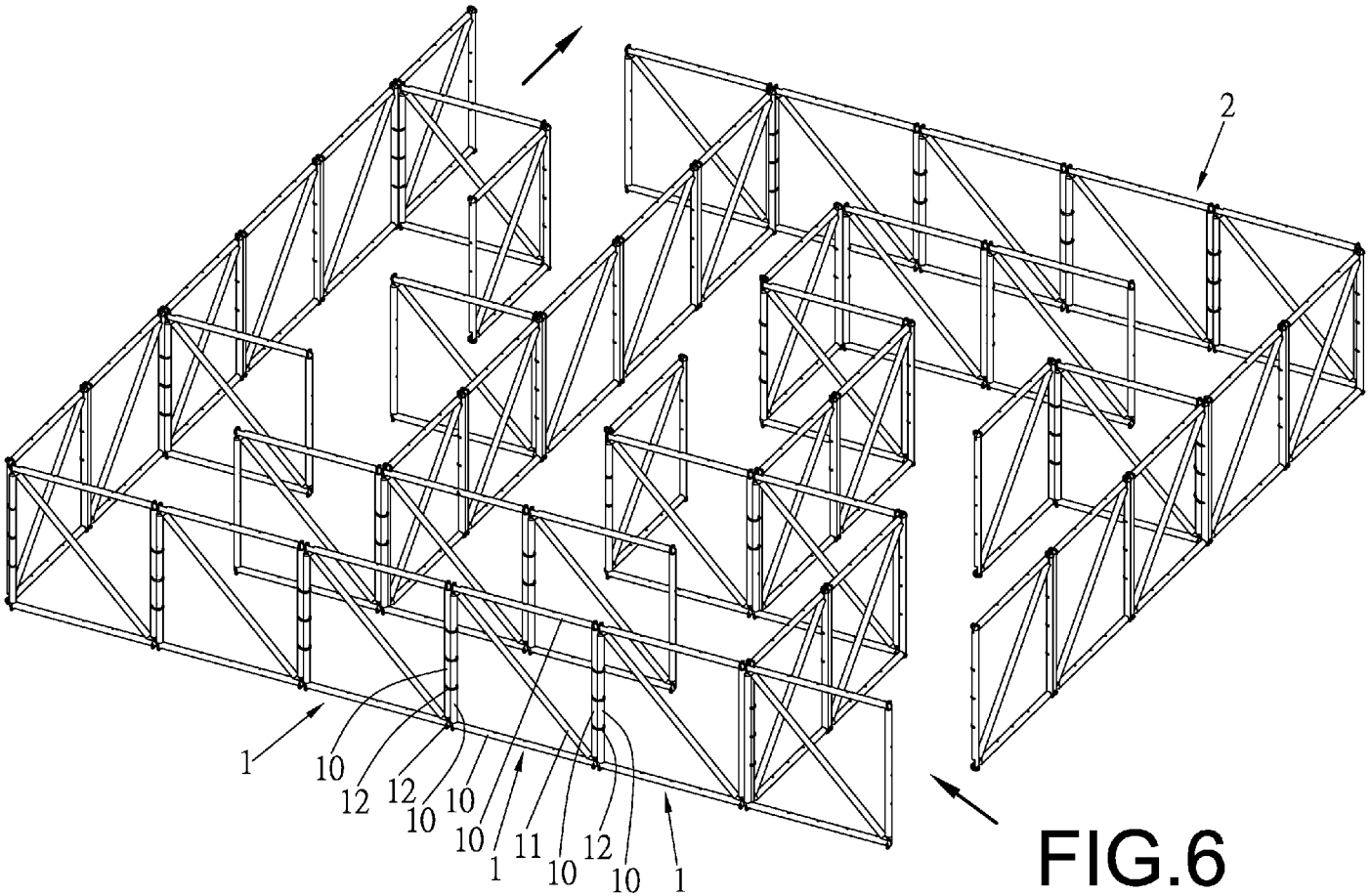
FIG. 6 is a perspective view of a first labyrinth made up by combining several labyrinth units together in the present invention.
Figure 7:
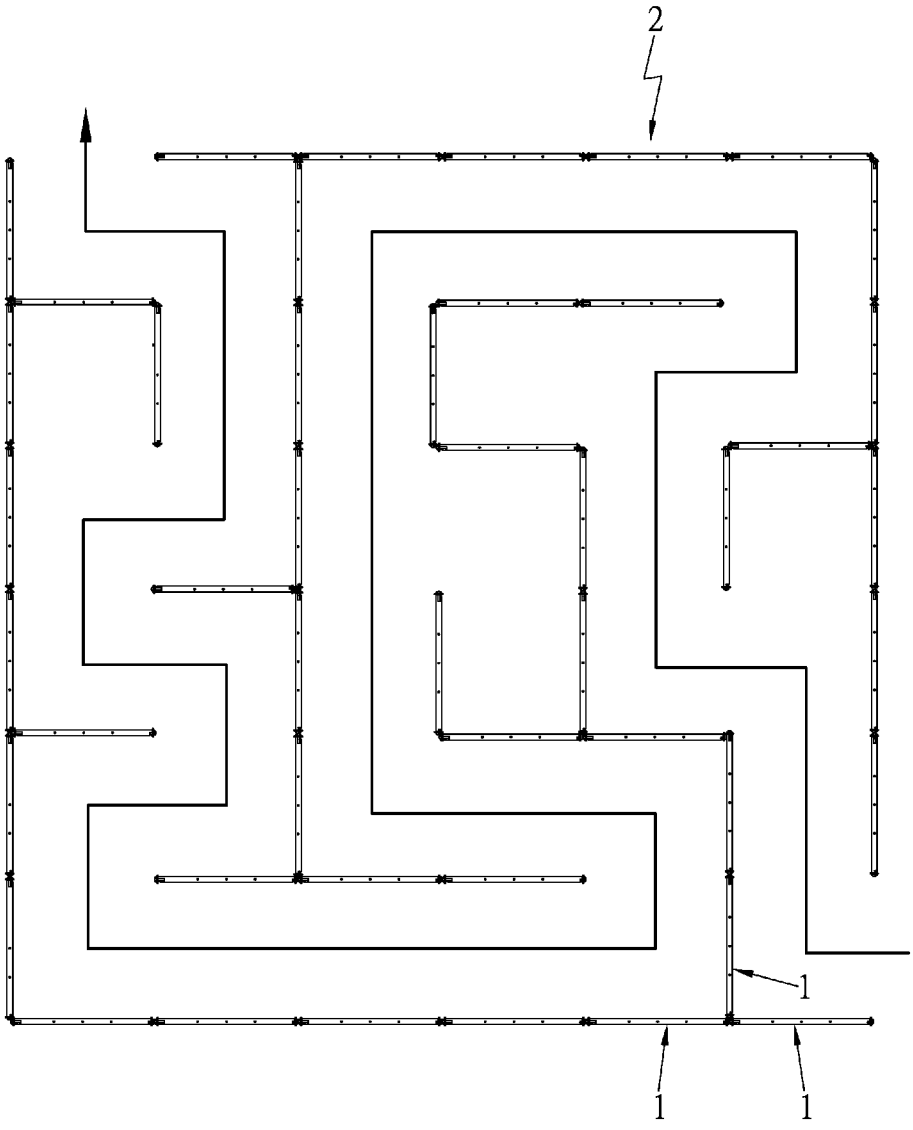
FIG. 7 is an upper view of the first labyrinth in the present invention.
Figure 8:
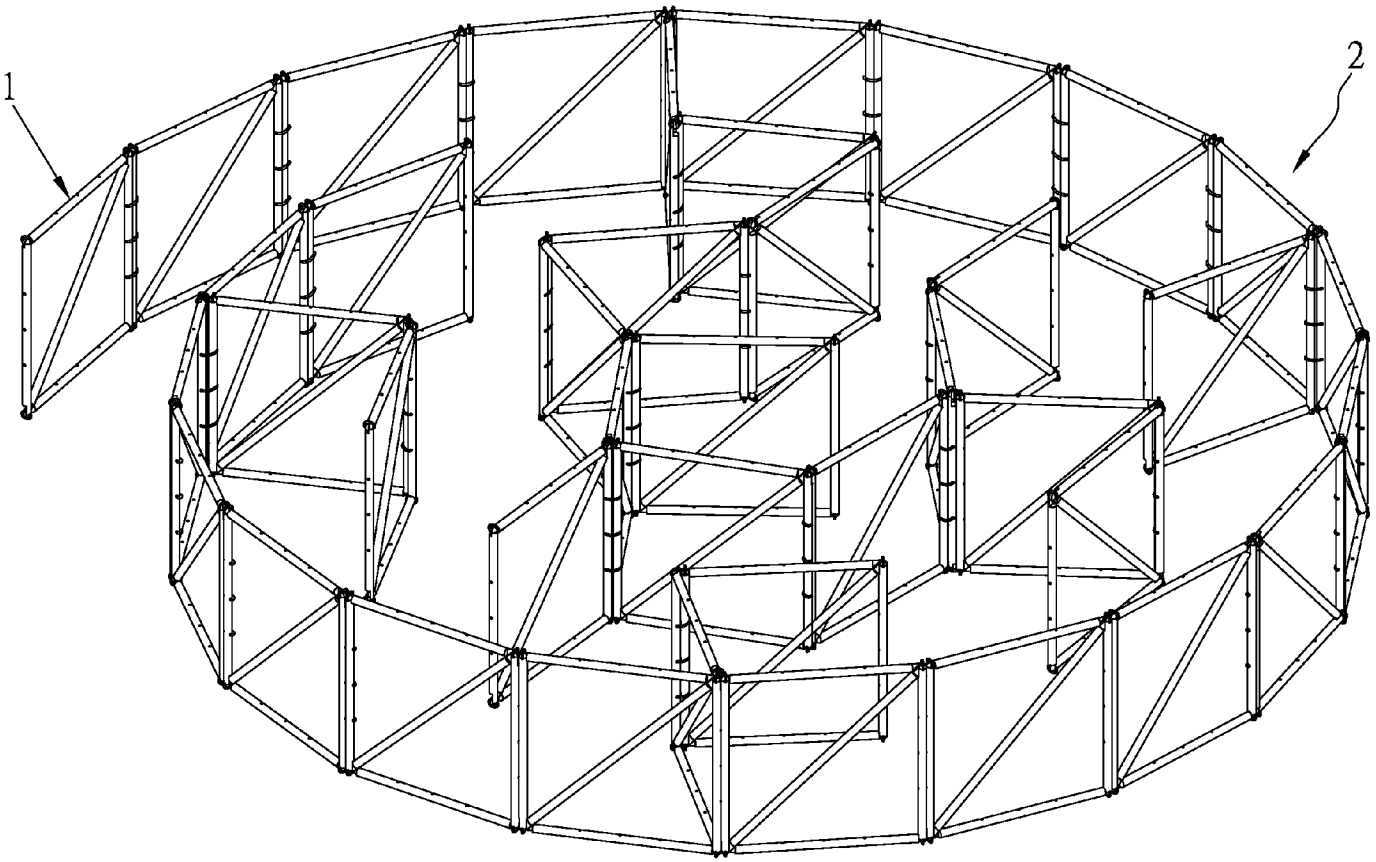
FIG. 8 is a perspective view of a second labyrinth of another shape in the present invention.

The fixing members 12 are to be respectively inserted through the insert holes 104, 105 of the connecting ends 100, 101 of the four mutually butt jointed frame rods 10 and through the insert holes 112 of the connecting ends 110 of the reinforcing support bar 11 for securing the four frame rods 10 and the reinforcing support bar 11 together. The fixing members 12 are tightening cords respectively having one end provided with female threads 120 and another end formed with male threads 121. In assembling, referring to FIGS. 1-5, firstly, the connecting ends 100 of two frame rods 10 are mutually butt jointed at a right angle, letting the connecting ends 100 of the two frame rods 10 received in the corresponding one-half recesses 102 and having the insert holes 104 of the connecting ends 100 of the frame rods 10 aligned to each other. Next, the fixing member 12 is inserted through two aligned insert holes 104 of the connecting ends 100 and has the male threads 121 at one end threadably combined with the female threads 120 at another end for stably fixing the two butt jointed ends 100 of the two frame rods 10. Afterward, the two connecting ends 110 of one reinforcing support bar 11 are respectively positioned in the two-thirds recesses 103 of the connecting ends 101 of the frame rods 10 that are vertically butt jointed to have the insert hole 112 of the connecting end 110 of the reinforcing support bar 11 aligned to the insert holes 105 at the connecting ends 101 of the frame rods 10. Subsequently, another two frame rods 10 are butt jointed at a right angle in another two frame rods 10 are butt jointed at a right angle in the same way as described above, respectively having another connecting end 101 lean on the connecting end 110 of the reinforcing support bar 11 and letting the insert hole 105 at the connecting ends 101 of the two frame rods 10 aligned to the insert hole 112 at the connecting end 110 of the reinforcing support bar 11. Then, a fixing member 12 is inserted through the insert holes 105 and 112 and has the male threads 121 at one end screwed with the female threads 120 at another end and thus, four frame rods 10 and one reinforcing support bar 11 can be firmly combined together to form a labyrinth unit 1, as shown in FIG. 4. To assemble two labyrinth units 1 together, simply have the two labyrinth units 1 contacting closely to let the insert holes 106 in the walls of two frame rods 10 respectively aligned to each other and then, have the fixing members 12 respectively inserted through the two mutually aligned insert holes 106 and tied up for securing two labyrinth units 1 together, as shown in FIG. 5. Hence, here completes an assembly of labyrinth unit In using, referring to FIGS. 6-8, after several labyrinth units 1 are assembled in foresaid modes, these labyrinth units 1 can be butt jointed one by one to make up a labyrinth 2 according to the labyrinth routes designed in advance. The labyrinth units 1 mutually butt jointed are adjustable in angles and can be assembled into a labyrinth with various shapes, as shown in FIGS. 7 and 8.

As can be understood from the above description, this invention has the following advantages.

1. The labyrinth of this invention can quickly and conveniently be assembled and disassembled, needless to employ any tool for help and can be adapted to any topography and set up at any site.

2. The labyrinth of this invention can easily be detached and reassembled into various labyrinths with different routes according to one's wish to make the labyrinth play diversified and maintain novelty of the labyrinth play, thus surely attaining an effect of performing teaching via amusement.

3. After being detached, the labyrinth units 1 are small in volume, taking less space, convenient to be transported and saving transportation cost further, the labyrinth units 1 will not be damaged and can be reused repeatedly.

4. After being assembled to make up a labyrinth, the labyrinth units 1 are hollowed so people outside the labyrinth 2 can directly observe the moving directions of the children playing in the labyrinth and clearly know where the children are, very safe in use.

While the preferred embodiment of the invention has been described above, it will be recognized and understood that various modifications may be made therein and the appended claims are intended to cover all such modifications that may fall within the spirit and scope of the invention.

What is claimed is:

1. A combination structure for a labyrinth comprising a plurality of labyrinth units, each said labyrinth unit composed of four frame rods, a reinforcing support bar and plural fixing members, said four frame rods having their ends mutually and vertically butt jointed to form into a square, each said frame rod having two ends respectively formed with a connecting end, said connecting end cut with a lengthwise recess and bored with an insert hole, each said frame rod bored with a plurality of insert holes in a wall of said frame rod, said reinforcing support bar obliquely set in said four frame rods, said reinforcing support bar having two ends respectively disposed with a connecting end, each said connecting end of said reinforcing support bar having two sides respectively cut with a lengthwise recess and bored with an insert hole, said fixing members inserted in said insert holes at said connecting ends of said four frame rods and at said connecting ends of said reinforcing support bar for securing said four frame rods and said reinforcing support bar together to make up a labyrinth unit; wherein one said connecting end of said frame rod is lengthwise cut with a one-half recess and another said connecting end of said frame rod is lengthwise cut with a two-thirds recess, while said reinforcing support bar has two sides of each said connecting end respectively and lengthwise cut with a one-third recess.

2. A combination structure for a labyrinth as claimed in claim 1, wherein said fixing members are tightening cords respectively having one end provided with female threads and another end disposed with male threads.

3. A combination structure for a labyrinth as claimed in claim 1, wherein one said labyrinth unit can be firmly combined together with another said labyrinth unit by means of said fixing members that are respectively inserted in two mutually-aligned said insert holes in the walls of said frame rods of said labyrinth units and threadably engaged.

* * * * *